United States Patent [19]

Garwood et al.

[11] 3,950,242

[45] Apr. 13, 1976

[54] FLUID CATALYTIC CRACKING PLUS SELECTIVE UPGRADING OF CRACKED GASOLINE

[75] Inventors: William E. Garwood, Haddonfield; Donald M. Nace, Woodbury; Hartley Owen, Belle Mead, all of N.J.

[73] Assignee: Mobil Oil Corporation, New York, N.Y.

[22] Filed: Apr. 2, 1974

[21] Appl. No.: 457,282

[52] U.S. Cl. ..... 208/70; 208/92; 208/93

[51] Int. Cl.[2] ..... C10G 37/10

[58] Field of Search .. 208/92, 93, 135, 137, DIG. 2, 208/69, 70

[56] References Cited

UNITED STATES PATENTS

| | | | |
|---|---|---|---|
| 2,890,997 | 6/1959 | Hirschler | 208/93 |
| 3,658,690 | 4/1972 | Graven | 208/92 |
| 3,729,409 | 4/1973 | Chen | 208/135 |
| 3,756,942 | 9/1973 | Cattanach | 208/138 |
| 3,759,821 | 9/1973 | Brennan et al. | 208/93 |
| 3,761,392 | 9/1973 | Pollock | 208/93 |

*Primary Examiner*—Herbert Levine

*Attorney, Agent, or Firm*—Charles A. Huggett; Carl D. Farnsworth

[57] ABSTRACT

A process combination is described for upgrading a gasoline product of fluid cracking by treatment with a ZSM-5 catalyst wherein the cracking operation is performed under conditions to provide a depentanized gasoline product of cracking containing not more than 15 wt.% olefins before ZSM-5 treatment thereof for octane improvement.

6 Claims, No Drawings

FLUID CATALYTIC CRACKING PLUS SELECTIVE UPGRADING OF CRACKED GASOLINE

BACKGROUND OF THE INVENTION

The technology of fluid catalytic cracking and related processes for upgrading gas oils to gasoline product has been a subject of study since early 1940. As new experience was gained in operating and design parameters, new catalyst compositions were developed which furthered refinement of known operating technology and combinations thereof. The development of highly active crystalline zeolite conversion catalysts opened the door to a new era of technology requiring further development and refinement to optimize efficiency of the operation and combinations therewith. The present invention is concerned with an improved combination operation which relies upon crystalline zeolite structures varying considerably in physical properties to upgrade higher boiling hydrocarbons to gasoline boiling product. The present invention is directed to an improvement on the combination of U.S. Pat. No. 3,759,821 issued Sept. 18, 1973. In this patent there is disclosed the cracking of gas oil boiling hydrocarbons to produce cracked gasoline product which is separated to recover a $C_7$+ gasoline fraction thereafter octane improved by passage over a ZSM-5 type of catalyst.

SUMMARY OF THE INVENTION

The present invention is concerned with an improvement on the combination process of U.S. Pat. No. 3,759,821, comprising catalytic cracking to produce gasoline followed by a selective treatment of a cracked gasoline product to improve its octane rating. More particularly the present invention is concerned with an improved combination operation directed to converting gas oil by cracking under particularly selected conditions to obtain a conversion level of at least 45 vol.% and a depentanized $C_6$+ gasoline fraction containing less than about 15% wt. olefins. The depentanized gasoline product of restricted olefin content is thereafter selectively upgraded in at least its octane value by contact with a ZSM-5 type conversion catalyst. In a more particular aspect, a depentanized gasoline product of gas oil cracking with a crystalline zeolite cracking catalyst under temperature, pressure catalyst/oil ratio and space velocity conditions which will particularly provide a first pass conversion level of at least 45% of 400°F. at 90% ASTM distillation gasoline comprising not more than about 15% olefins in the depentanized $C_6$+ gasoline product fraction thereof can be octane improved by contact with a ZSM-5 type of crystalline zeolite without substantial yield loss. The gasoline product of cracking obtained under the particularly selected operating conditions herein defined is separated to recover $C_5$ and lower boiling constituents from a depentanized gasoline fraction; the depentanized gasoline fraction is thereafter contacted with a ZSM-5 type of crystalline aluminosilicate at a temperature in the range of 500° to 800°F. either with or without the presence of hydrogen and a hydrogenating metal component to selectively change the octane number and composition of the gasoline product so obtained. Thereafter high octane components of the separated $C_5$ and lighter material recovered from the gasoline product of cracking may be blended with the higher octane ZSM-5 gasoline product.

The fluid catalytic cracking (FCC) conversion operation of this invention is preferably carried out in one or more riser conversion zones employed for catalytic cracking gas oil boiling range feed materials and heavy recycle fractions thereof at a temperature selected from within the range of 800° to 1100°F. employing a hydrocarbon residence time in the range of 1 to 10 seconds and a pressure within the range of atmospheric to about 100 psig. In the fluid catalyst cracking operation the catalyst to oil ratio is usually maintained above that normally employed, such as within the range of 5 to 20 and is adjusted in relationship to the above recited operating parameters to provide a first pass conversion level of at least 45 wt.% and a depentanized or $C_6$+ gasoline product containing not more than 15 wt.% olefins and preferably not more than about 10 wt.% olefins. In such an operation, low temperatures and high conversions both act to decrease the olefins in the product gasoline. Also the ability to lower the olefin content of the gasoline by lowering cracking temperatures and increasing catalyst to oil ratio are demonstrated below. Increasing the catalyst to oil ratio may be practiced by recycling used stripped catalyst to the inlet of a riser conversion zone for admixture with freshly regenerated catalyst. On the other hand, a dual riser hydrocarbon conversion operation may be employed in which the lower boiling portion of the gas oil feed may be cracked in one riser at a relatively high temperature suitable for producing the product desired. The remaining higher boiling portion of the feed is cracked in a separate riser reactor or conversion zone in the presence of freshly regenerated catalyst in admixture with catalyst cascaded from the first riser conversion zone to maintain the desired catalyst to oil ratio therein as desired. A still further method for reducing olefins in the gasoline product of cracking can be had by recycling a distillation cut of gasoline back to a riser for a recracking thereof. The type of gas oil feed and its composition will alter the cracking operating parameters required to provide a depentanized gasoline product (90% ASTM of 400°F) containing preferably less than 15 wt.% olefins (mono-olefins plus cyclo-olefins).

EXAMPLES

A. A Durban Fresh Feed identified in Table I below was passed in contact with a cracking catalyst comprising 10% REY (rate earth exchanged "Y" faujasite) dispersed in a silica, zirconia, clay matrix. The cracking operation and results obtained are as defined in Table II.

TABLE I

| DURBAN FRESH FEED | |
|---|---|
| Gravity, API | 23.8 |
| Sulfur, % wt. | 2.08 |
| Nitrogen, % wt. | 0.10 |
| Conradsen Carbon, % wt. | 0.23 |
| Hydrogen, % wt. | 12.3 |
| Molecular wt. | 357 |
| Distillation, ibp, °F. | 520 |
| 5% vol. | 622 |
| 10% vol. | 660 |
| 20% vol. | 705 |
| 30% vol. | 740 |
| 40% vol. | 774 |
| 50% vol. | 804 |
| 60% vol. | 837 |
| 70% vol. | 866 |
| 80% vol. | 897 |
| 90% vol. | 937 |
| 95% vol. | 960 |
| Composition, Paraffin % wt. | 25.3 |

TABLE I-continued

| DURBAN FRESH FEED | |
|---|---|
| Naphthenes | 27.3 |
| Aromatics | 47.4 |
| % C, (Aromatic Ring Carbon) | 19.0 |

TABLE II

| Riser Cracking Temp. 1000°F. | | | |
|---|---|---|---|
| Conversion (wt.% > 430°F) | 60 | 70 | 80 |
| Cat/oil ratio | 3.0 | 6.0 | 19.0 |
| % Olefins in $C_6$+ gasoline | 38.1 | 18.7 | 5.8 |

(B) A Clark Gas Oil identified in Table III was passed in contact with a 10% REY cracking catalyst identified in (a) above employing a pressure of 32 psia and a 2.5 second hydrocarbon residence time.

B. A Clark Gas Oil identified in Table III was passed in contact with a 10% REY cracking catalyst identified in (a) above employing a pressure of 32 psia and a 2.5 second hydrocarbon residence time.

TABLE III

| CLARK GAS OIL | |
|---|---|
| Gravity, API | 28.9 |
| Sulfur, wt.% | 0.37 |
| Nitrogen, wt.% | 0.062 |
| Conradsen Carbon, wt.% | 0.18 |
| Hydrogen, wt.% | 13.0 |
| Molecular wt. | 354 |
| Distillation, ibp | 388 |
| 5% vol. | 509 |
| 10% vol. | 554 |
| 20% vol. | 621 |
| 30% vol. | 658 |
| 40% vol. | 694 |
| 50% vol. | 732 |
| 60% vol. | 770 |
| 70% vol. | 813 |
| 80% vol. | 859 |
| 90% vol. | 915 |
| 95% vol. | 953 |
| Composition, Paraffin, wt.% | 23.7 |
| Naphthenes, wt.% | 44.2 |
| Aromatics, wt.% | 32.1 |
| % C, (Aromatic Ring Carbon) | 12.2 |

The results obtained at different conversion levels and two different cracking temperature conditions are shown in Table IV.

TABLE IV

| Conversion, Wt.% | 60 | 70 | 80 |
|---|---|---|---|
| 950°F | | | |
| R + O Octane Number ($C_5$+ Gasoline) | 84.1 | 82.8 | 83.0 |
| Yield $C_5$+ Gasoline, wt.% | 48.1 | 53.6 | 55.0 |
| Cat/Oil, wt. | 2.7 | 5.0 | ~14 |
| Wt.% Olefin ($C_6$+ Gaso.) | 26.0 | 15.5 | 6.5 |
| 1050°F | | | |
| R + O Octane Number ($C_5$+ Gaso) | | 91.0 | 90.0 |
| Yield $C_5$+ Gaso., wt.% | | 49.0 | 51.7 |
| Cat/Oil, wt. | | 2.65 | 7.0 |
| Wt.% Olefin ($C_6$+ Gasoline) | | 34.5 | 14.5 |

C. An early study processing (WCMCGO) Wide Cut Mid-Continent Gas Oil by cracking with a 10% REY dispersed in silicazirconia-clay catalyst at a pressure of 35 psia and a hydrocarbon residence time of 3 seconds provided the following comparative data.

C. An early study processing (WCMCGO) Wide Cut Mid-Continent Gas Oil by cracking with a 10% REY dispersed in silicazirconia-clay catalyst at a pressure of 35 psia and a hydrocabon residence time of 3 seconds provided the following comparative data.

TABLE V

| Conversion, wt.% | 50 | 60 | 70 | 80 |
|---|---|---|---|---|
| 900°F | | | | |

TABLE V-continued

| | | | | |
|---|---|---|---|---|
| R + O Octane Number ($C_5$+ Gaso) | 81.6 | 80.7 | 80.6 | 82.8 |
| Yield $C_5$+ Gaso., wt.% | 39.0 | 46.0 | 50.8 | 50.7 |
| Cat/Oil, wt. | 4.7 | 6.9 | 13.2 | |
| Wt.% Olefin ($C_6$+ Gaso.) | 25.0 | 18.6 | 11.1 | 4.4 |
| 1000°F. | | | | |
| R + O Octane Number ($C_5$+ Gaso) | 88.6 | 88.1 | 87.7 | 88.3 |
| Yield $C_5$+ Gaso., wt.% | 36.6 | 43.7 | 49.0 | 48.3 |
| Cat/Oil, wt. | 2.7 | 3.8 | 7.0 | 21.0 |
| Wt.% Olefin ($C_6$+ Gaso.) | 43.5 | 34.0 | 22.6 | 9.7 |

In another aspect, the present invention contemplates the recracking of gasoline products of high olefin content to reduce the olefins to an acceptable level. For example, a $C_6$+ Coastal States FCC gasoline comprising 23% olefins was passed over the catalyst of (A) above at a temperature of 1000°F., 7 C/O ratio and a 4 seconds oil residence time. The product obtained comprised 83.1 vol.% $C_6$+ gasoline of 6% olefins plus 4.6 vol.% $C_5$'s plus 14.8 vol.% of material identified as alkylate (alkylate feed).

High olefinic content gasoline such as coker gasoline containing 35% olefins and identified as Paulsboro heavy coker gasoline was passed in contact with the catalyst of "A" above at a temperature of 1000°F; 3 C/O ratio and a 4 second hydrocarbon residence time. The product obtained comprised 77.1 vol.% $C_6$+ gasoline of 8.1% olefins + 7.5 vol.% $C_5$'s + 11.9 vol.% of material identified as alkylate (alkylate feed).

Following the cracking of hydrocarbon charge materials as herein identified and separation thereof to obtain gasoline and lower boiling constituents, light cycle oil, heavy cycle oil and clarified slurry oils, the insufficiently converted hydrocarbon material is recycled to the cracking operation and a separation is made to recover $C_5$ and lower boiling components from a higher boiling $C_6$+ or depentanized gasoline fraction of less than 15 wt.% olefins and 400°F. at its 90% ASTM distillation point. The separated $C_5$ material will normally contain considerable amylene which is a high octane product useful for blending with the higher boiling final gasoline product if desired.

In the combination operation of this invention the depentanized gasoline product of catalytic cracking is selectively upgraded by contact with a ZSM-5 type catalyst. The selective upgrading operation may be completed in the presence of a ZSM-5 type of catalyst either in the presence or absence of a Group VIII metal promoter having hydrogenation activity and either in the presence or absence of added hydrogen. It is preferred that the selective upgrading be accomplished with a nickel promoted ZSM-5 in the presence of hydrogen at conditions including a temperature selected from within the range of 500°F. to about 800°F. and a pressure in the range of 0 to 1000 psig (preferably 300 to 600 psig). A hydrogen to hydrocarbon partial pressure ratio of at least 2/1 is also preferred for maintaining catalyst on stream life. However, even in the absence of hydrogen, the ZSM-5 catalyst has a most acceptable life span in the operating combination of this invention.

EXAMPLE I

A composite gasoline blend was obtained by cracking Mid-Continent Gas Oil over a 10 wt.% REY cracking catalyst in a series of runs at 30 psig, 900°F. where the conversion ranged from 70–84%. The $C_6$+ composite gasoline blend had the following characteristics:

| | |
|---|---|
| Gravity, API | 56.1 |
| Specific | 0.7543 |
| RON (O ml TEL) | 78.0 |
| Mono-olefins wt.% | 6.6 |
| Cyclo olefins wt.% | 1.2 |

The composite gasoline above identified was passed over a 0.49 wt.% Ni promoted ZSM-5 catalyst identified as Ni/H/ZSM-5. The operating conditions employed were:

| | |
|---|---|
| Pressure psig | 400 |
| LHSV | 11.6 |
| $H_2$/HC mole ratio | 5.6 |
| Temperature °F. | 605 |

Yields were:

| | |
|---|---|
| Methane, wt.% | <0.01 |
| Ethane, wt.% | 0.02 |
| Propane, wt.% | 2.28 |
| $C_4$'s vol.% | 3.1 |
| $C_5$+ gasoline vol.% | 93.8 |
| Mono-olefins, wt.% | 1.2 |
| Cyclo-olefins, wt.% | 1.0 |
| $C_5$+ gasoline (R.O.N.) | 80.9* |
| Ratio Yield loss/Octane Gain | 2.1 |

*2.9 over charge.

Total olefin content was reduced from 7.8 to 2.2, with an increase in octane number from 78.0 to 80.9.

EXAMPLE II

A cracking operation was completed similar to that recited in Example I except that the conversion conditions were selected to produce a gasoline product of higher olefin content. A composite gasoline ($C_5$-430°F) with a RON (0 ml TEL) of 81.2 was formed. The composite gasoline had the following properties:

| | |
|---|---|
| Gravity, API | 55.0 |
| Specific | 0.7587 |
| RON (O ml TEL) | 81.2 |
| Mono-olefins, wt.% | 15.1 |
| Cyclo-olefins, wt.% | 5.5 |

This composite gasoline was passed in contact with the Ni/H/ZSM-5 catalyst identified in Example I and at the same conditions. The yields from this operation were:

| | |
|---|---|
| Methane, wt.% | 0.01 |
| Ethane, wt.% | 0.12 |
| Propane, wt.% | 1.36 |
| $C_4$'s, vol.% | 2.5 |
| $C_5$+ gasoline, vol.% | 96.4 |
| Mono-olefins, wt.% | 9.8 |
| Cyclo-olefins, wt.% | 5.2 |
| $C_5$+ gasoline (RON) | 82.5* |
| Ratio, yield loss/Octane Gain | 2.8. |

*1.3 over charge.

Total olefin content was reduced from 20.6 to 15.0, with an increase in octane number from 81.2 to 82.5.

EXAMPLE III

A gasoline product of FCC, boiling 158° to 250°F. had the following properties:

| | |
|---|---|
| Gravity, API | 56.5 |
| Specific | 0.7527 |
| RON (O ml TEL) | 87.7 |
| Mono-olefins, wt.% | 22 |
| Cyclo-olefins, wt.% | 12 |

A ZSM-5 catalyst free of a nickel promoter as used in Examples 1 and 2 was used to upgrade the above high olefin content gasoline at the conditions of 400 psig, 12.5 LHSV, 7.6 $H_2$/HC mole ratio and 700°F. The yields were:

| | |
|---|---|
| Methane, wt.% | 0.08 |
| Ethane, wt.% | 0.65 |
| Propane, wt.% | 5.14 |
| $C_4$'s vol.% | 10.3 |
| $C_5$+ gasoline vol. % | 85.0 |
| $C_5$+ gasoline (R.O.N.) | 85.4 |

The RON of the product $C_5$+ gasoline was 2.3 numbers lower than the charge gasoline in addition to a 15 vol.% yield loss.

It is thus clear from the examples and disclosure of this invention that to raise the octane number of a cracked gasoline of high olefin content, it is necessary outside the scope of this invention to first pretreat to saturate olefins (which lowers octane number) and thereafter reform to dehydrogenate naphthenes and form aromatics. However, when practicing the concepts of this invention one or both of these steps may be eliminated. On the other hand, a mild hydrogenation to saturate a small amount of olefins in a depentanized $C_6$+ fraction might be desirable to minimize yield loss.

The catalyst compositions suitable for use in the combination operation of this invention, comprise both small and large pore crystalline zeolites or crystalline aluminosilicates. The large and small pore crystalline zeolites are each dispersed in a matrix material suitable for encountering to high operating temperatures to which they will be exposed. The small pore catalyst composition of the present invention is preferably a ZSM-5 type of catalyst composition. Such a catalyst composition is described in U.S. Pat. Nos. 3,702,886 and 3,729,409 and the description of such a catalyst composition is to be incorporated herein by reference thereto. The large pore crystalline zeolite conversion catalyst is preferably a rare earth exchanged "X" or "Y" crystalline faujasite material which is dispersed in a suitable matrix material. The large pore crystalline zeolite may be exchanged with, combined, dispersed or otherwise intimately admixed with the porous matrix. By porous matrix it is intended to include inorganic and orgnic compositions with which the crystalline aluminosilicate may be affixed. The matrix may be active or substantially inactive to the hydrocarbon conversion reactions encountered. A preferred porous matrix may be selected from the group comprising inorganic oxides such as clay, acid treated clay, silica, alumina and mixtures thereof. A more complete description of large pore zeolite cracking catalyst suitable for use in the cracking operation of this invention may be found in U.S. Pat. No. 3,556,988 issued Jan. 19, 1971.

Hydrocarbon charge stocks which may be converted by the combination operation of this invention comprise petroleum fractions having an initial boiling point in the range of 400°F. to 600°F. and a final boiling point in the range of 950°F. to 1100°F. Hydrocarbons boiling above 400°F. include gas oils, residual oils, cycle stocks, whole topped crudes and heavy hydrocarbon fractions derived by destructive hydrogenation processes.

Having thus generally described the present invention and provided examples in support thereof, it is to be understood that no undue restrictions are to be imposed by reason thereof except as defined by the following claims.

We claim:

1. A method for producing gasoline boiling range product which comprises, cracking a petroleum fraction boiling from about 400°F. to about 1100°F. in the presence of a crystalline zeolite cracking catalyst under conditions of temperature, pressure, space velocity and catalyst to oil ratio providing a conversion level of at least 2. The method of claim 1 wherein cracking of the petroleum fraction is accomplished at a temperature selected from within the range of 800°F. to about 1100°F. at a catalyst to oil ratio in the range of 5 to 20.

3. The method of claim 1 wherein the depentanized gasoline product of cracking is octane improved by contact with the ZSM-5 type catalyst at a hydrogen to hydrocarbon partial pressure ratio of at least 2/1.

4. The method of claim 1 wherein cracking of the petroleum fraction occurs in a riser cracking operation and upgrading of depentanized gasoline product of cracking is accomplished in a dense fluid bed catalyst.

5. The method of claim 1 wherein the depentanized gasoline product of cracking is restricted to contain not more than about 10 wt.% olefins before contact with said ZSM-5 type catalyst.

6. The method of claim 1 wherein low boiling components separated from the depentanized gasoline contain amylene suitable for blending with the gasoline product of said ZSM-5 contacting step.

* * * * *

UNITED STATES PATENT AND TRADEMARK OFFICE

CERTIFICATE OF CORRECTION

PATENT NO. : 3,950,242

DATED : April 13, 1976

INVENTOR(S) : William E. Garwood, Donald M. Nace and Hartley Owen

It is certified that error appears in the above-identified patent and that said Letters Patent are hereby corrected as shown below:

Column 2, line 48 "rate" should be -- rare --

Column 6, line 33 "to" should be -- the --

Column 7, line 10 The following should be inserted in Claim 1:

--45 vol. % of said fraction to produce a material having a 90% ASTM boiling point of 400°F. and comprising not more than 15 wt. % olefins in the depentanized gasoline product thereof, and contacting the depentanized gasoline product of restricted olefin content with a ZSM-5 type crystalline zeolite conversion catalyst at a temperature within the range of 500 to 800°F. to produce a higher octane product.--

Signed and Sealed this

Twenty-first Day of September 1976

[SEAL]

*Attest:*

RUTH C. MASON
*Attesting Officer*

C. MARSHALL DANN
*Commissioner of Patents and Trademarks*